US008561218B1

(12) United States Patent
Arce

(10) Patent No.: US 8,561,218 B1
(45) Date of Patent: Oct. 22, 2013

(54) TOILET FLANGE STABILIZER

(76) Inventor: Rigo Arce, Watsonville, CA (US)

( * ) Notice: Subject to any disclaimer, the term of this patent is extended or adjusted under 35 U.S.C. 154(b) by 290 days.

(21) Appl. No.: 13/034,543

(22) Filed: Feb. 24, 2011

(51) Int. Cl.
*E03D 11/16* (2006.01)

(52) U.S. Cl.
USPC ..... 4/252.4

(58) Field of Classification Search
USPC ..... 4/252.1–252.6
See application file for complete search history.

(56) References Cited

U.S. PATENT DOCUMENTS

| | | | | |
|---|---|---|---|---|
| 1,613,926 | A | 1/1927 | Bropson | |
| 1,702,976 | A | 2/1929 | Moore | |
| 2,159,021 | A * | 5/1939 | Groeniger | 4/252.3 |
| 3,198,554 | A * | 8/1965 | Hartshorn, Jr. | 285/64 |
| 3,409,918 | A | 11/1968 | Gaddy | |
| 3,419,288 | A | 12/1968 | Logsdon | |
| D255,481 | S | 6/1980 | Moore | |
| 4,648,139 | A | 3/1987 | Stokes | |
| 4,780,915 | A | 11/1988 | Cuschera | |
| 4,886,302 | A | 12/1989 | Forbes | |
| 5,451,081 | A | 9/1995 | Kaucnik | |
| 5,890,239 | A * | 4/1999 | Hite | 4/252.5 |
| D647,181 | S * | 10/2011 | Kovach | D23/259 |

* cited by examiner

*Primary Examiner* — Gregory Huson
*Assistant Examiner* — Christine Skubinna

(57) ABSTRACT

A toilet flange stabilizer comprising a flat ring with a center hole, wherein the flat ring is sized to fit over a lip of a flange; a plurality of holes disposed on the flat ring; a plurality of slots disposed on the flat ring; a plurality of arms attaching to an outer periphery of the flat ring and the arms radiating away from the flat ring, further a first segment of the arms extend downward from the flat ring and then a second segment of the arms bend upward wherein the second segments lie on a first plane that is parallel to a second plane of the flat ring; and an arm hole disposed on each second segment of each arm; wherein the toilet flange stabilizer rests over the lip of a flange.

4 Claims, 4 Drawing Sheets

Isometric View

Isometric View

Side View

Top View

Cross Section

Industrial Version

TOILET FLANGE STABILIZER

BACKGROUND OF THE INVENTION

The present invention is directed to a toilet flange stabilizer. The stabilizer device of the present invention provides an easy and convenient way to stabilize a toilet on a toilet flange over a drain without having to rebuild or remove flooring.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
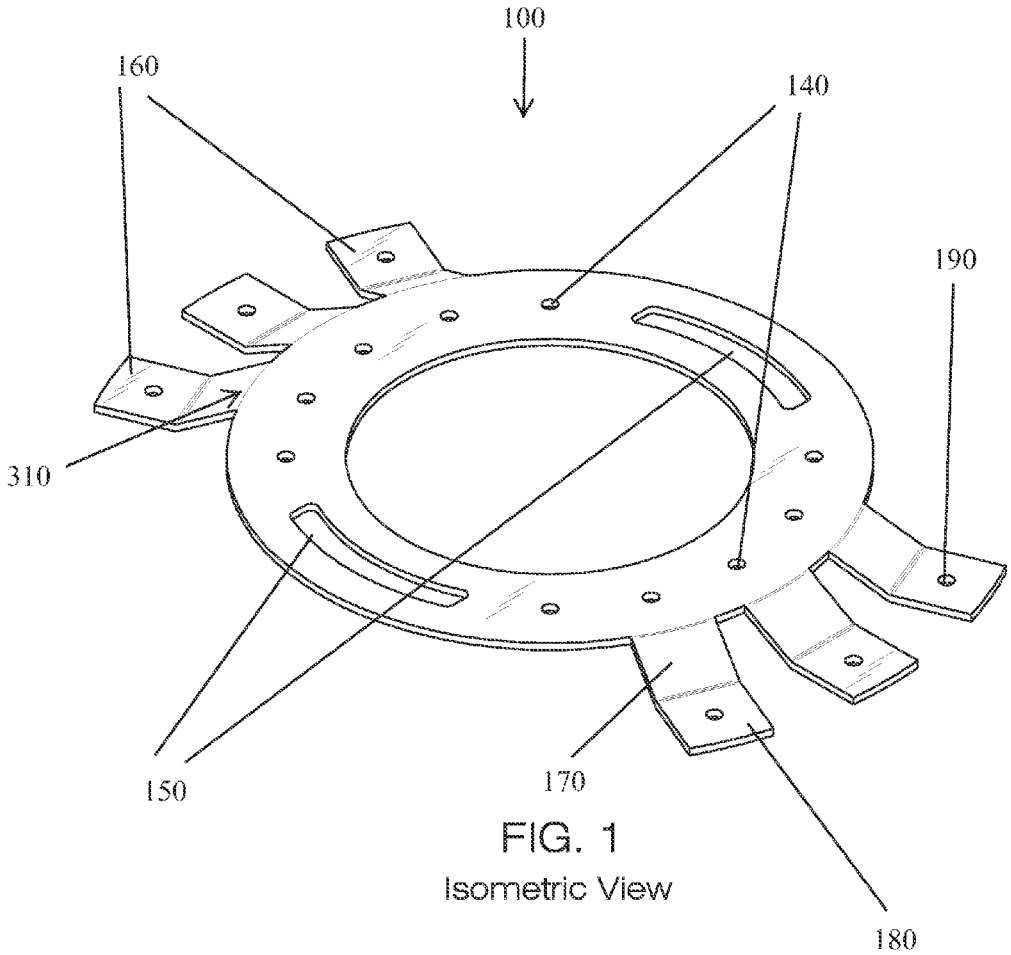
FIG. 1 shows a perspective view of a toilet flange stabilizer.
Figure 2:
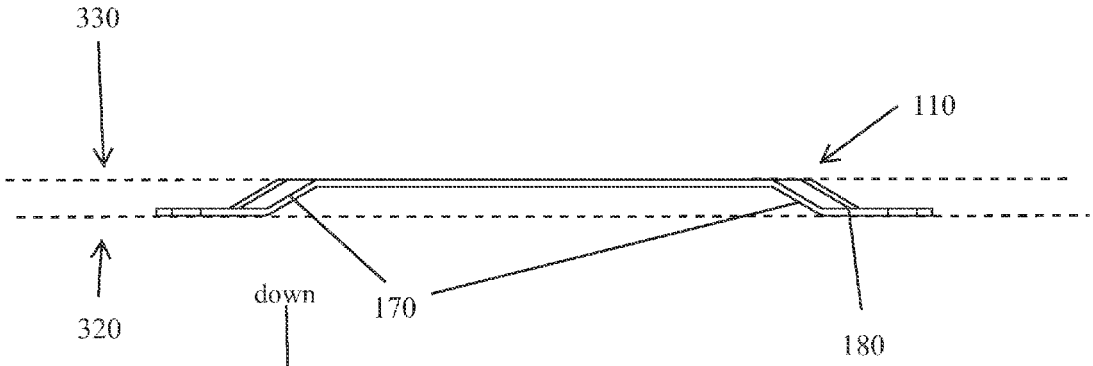
FIG. 2 shows a front view of a toilet flange stabilizer.
Figure 3:
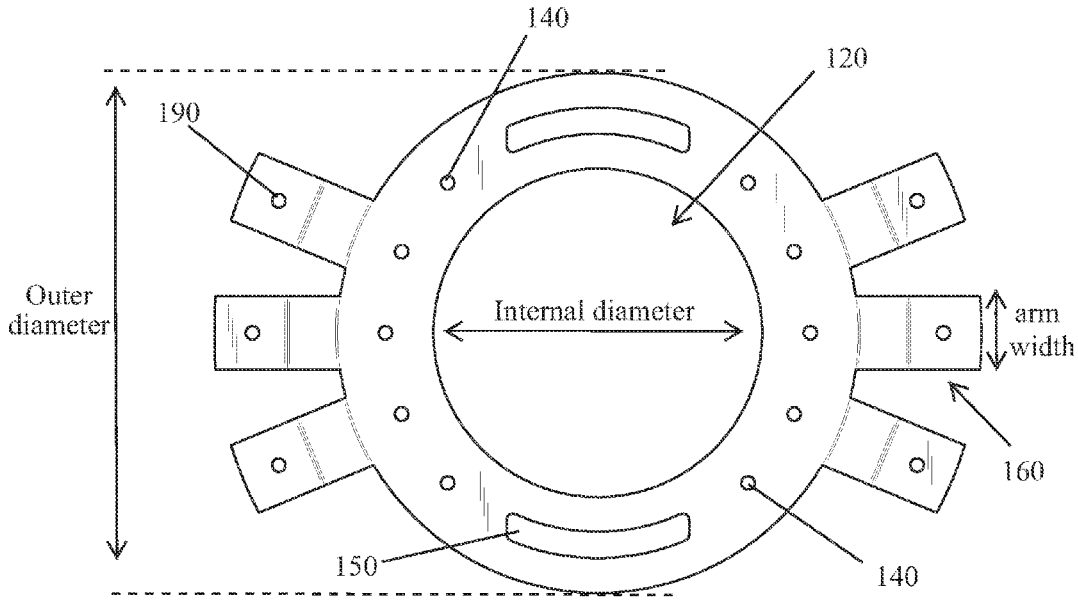
FIG. 3 shows a top view of a toilet flange stabilizer.
Figure 4:
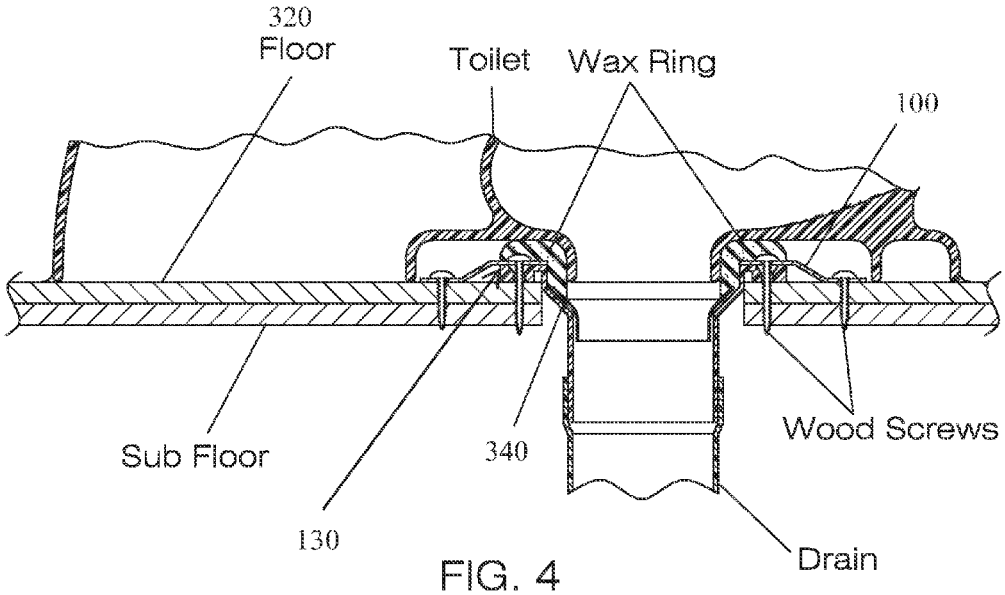
FIG. 4 shows a cross sectional view of a toilet flange stabilizer in use with a toilet system.
Figure 5:
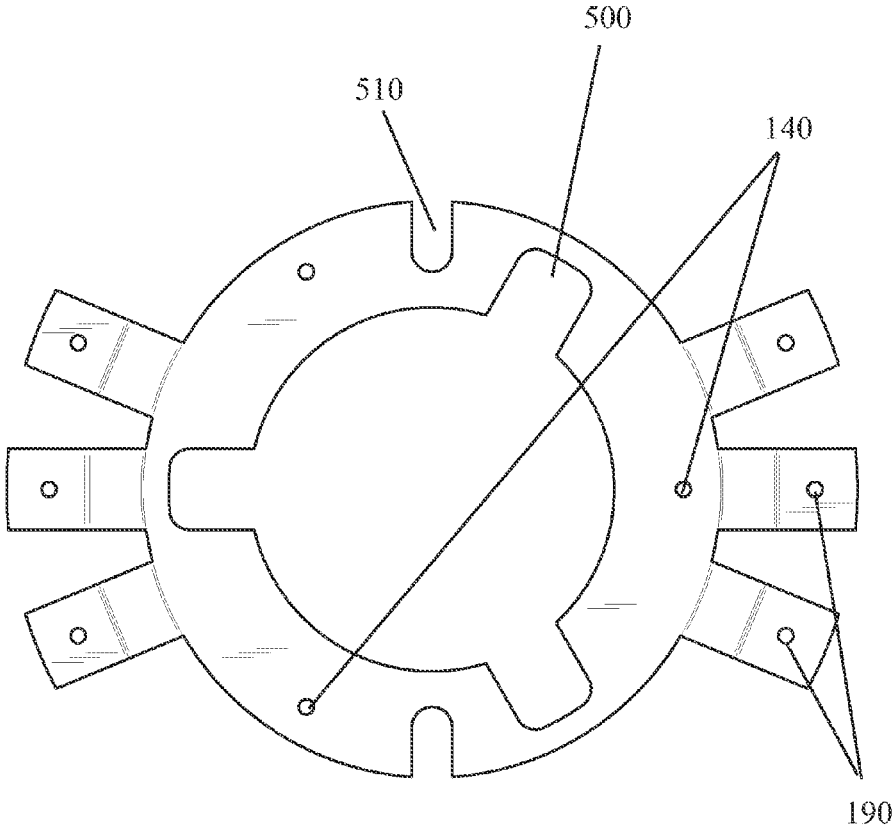
FIG. 5 shows a top view of an industrial version of a toilet flange stabilizer.
Figure 6:
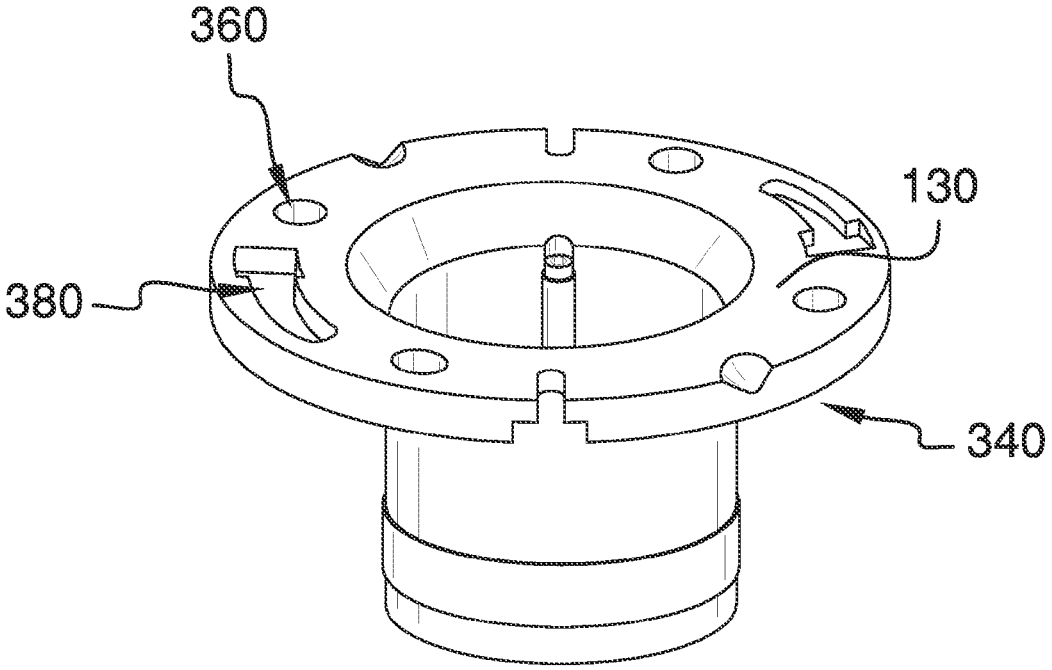
FIG. 6 shows a perspective view of a toilet flange.

Referring now to FIG. 1-6, the present invention features a toilet flange stabilizer 100 comprising a flat ring 110 with a center hole 120 which, in some embodiments, is about 4½ inches in diameter, wherein the flat ring is sized to fit over a lip 130 of a flange. In some embodiments, the stabilizer further comprises a plurality of holes 140 which are about 3/16 of an inch disposed on the flat ring, and a plurality of slots 150 which are about 2½ inches wide disposed on the flat ring. In some embodiments, the stabilizer comprises internal knockouts 500 which are about 1 inch wide and long disposed on the inner portion of the flat ring, and external knockouts 510 which are about ⅞ inch long and ½ inch wide disposed on the outer portion of the flat ring. These radially oriented slots are in place for an industrial version of mounting bolts and take the place of the usual arc-shaped slots for standard or residential toilet mounting.

The stabilizer further comprises a plurality of arms 160 which are about 1 inch in width, attaching to an outer periphery 310 of the flat ring. The arms radiate away from the flat ring. The stabilizer further comprises a first segment 170 of the arms which extend downward from the flat ring and then a second segment 180 of the arms which bend upward or flattens out being parallel to the ground. The second segments lie on a first plane 320 that is parallel to a second plane 330 of the flat ring, and an arm hole 190 is disposed on each second segment of each arm. In some embodiments, the arms radiate away from the flat ring and the arms curves downward away from the plane of the ring.

In some embodiments the toilet flange stabilizer 100 rests over the lip of a flange 340. In some embodiments the toilet flange stabilizer has a plurality of holes which are at a first location that matches a plurality of flange holes 360 on the flange disposed below the toilet flange stabilizer. In some embodiments, the toilet flange stabilizer contains a plurality of slots which are at a second location that matches a plurality of flange slots 380 on the flange disposed below the toilet flange stabilizer.

In some embodiments, the toilet flange stabilizer comprises at least two arms. In some embodiments the toilet flange stabilizer comprises at least four arms. In some embodiments the toilet flange stabilizer comprises at least six arms.

In some embodiments, the toilet flange stabilizer comprises one arm on one side of the ring and another arm on an opposite side of the ring. In some embodiments, the toilet flange stabilizer comprises a set of two arms on one side of the ring and another set of two arms on an opposite side of the ring. In some embodiments, the toilet flange stabilizer comprises a set of three arms on one side of the ring and another set of three arms on an opposite side of the ring.

In some embodiments, the toilet flange stabilizer can be constructed from a metal material. In some embodiments, the toilet flange stabilizer can be constructed from an alloy materiel.

As used herein, the term "about" refers to plus or minus 10% of the referenced number.

Venous modifications of the invention, in addition to those described herein, will be apparent to those skilled in the art from the foregoing description. Such modifications are also intended to fail within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A toilet flange stabilizer (100) comprising:

(a) a flat ring (110) with a center hole (120), wherein the flat ring is sized to fit over a lip (130) of a flange;

(b) a plurality of holes (140) disposed on the flat ring;

(c) a plurality of slots (150) disposed on the flat ring;

(d) a plurality of elongated arms (160) attaching to an outer periphery (310) of the flat ring, the arms (160) comprise a length at least twice the width, the arms radiate away from the flat ring, further a first segment (170) of the arms extends downward from the flat ring and then a second segment (180) of the arms bends upward, the second segments lie on a first plane (320) that is parallel to a second plane (330) of the flat ring, wherein a second set of three arms (160) is disposed opposed to a first set of three arms (160) on the outer periphery (310) of the flat ring (110); and (e) an arm hole (190) disposed on each second segment of each arm;

wherein the toilet flange stabilizer (100) rests over the lip of a flange (340).

2. The toilet flange stabilizer of claim 1 being constructed from a metal material.

3. The toilet flange stabilizer of claim 1 being constructed from an alloy material.

4. A toilet flange stabilizer (100) consisting of:

(a) a flat ring (110) with a center hole (120), wherein the flat ring is sized to fit over a lip (130) of a flange;

(b) a plurality of holes (140) disposed on the flat ring;

(c) a plurality of slots (150) disposed on the flat ring;

(d) a plurality of elongated arms (160) attaching to an outer periphery (310) of the flat ring, the arms (160) consists of a length at least twice the width, the arms radiate away from the flat ring, further a first segment (170) of the arms extends downward from the flat ring and then a second segment (180) of the arms bends upward, wherein the second segments lie on a first plane (320) that is parallel to a second plane (330) of the flat ring, wherein a second set of three arms (160) is disposed opposed to a first set of three arms (160) on the outer periphery (310) of the flat ring (110); and (e) an arm hole (190) disposed on each second segment of each arm;

wherein the toilet flange stabilizer (100) rests over the lip of a flange (340).

* * * * *